US007600582B2

(12) United States Patent
Wright, Jr. et al.

(10) Patent No.: US 7,600,582 B2
(45) Date of Patent: Oct. 13, 2009

(54) SONDE HOUSING

(75) Inventors: Ronald (Riff) F. Wright, Jr., Weatherford, TX (US); David G. Bullock, Weatherford, TX (US)

(73) Assignee: Texas HDD, LLC, Weatherford, TX (US)

( * ) Notice: Subject to any disclaimer, the term of this patent is extended or adjusted under 35 U.S.C. 154(b) by 172 days.

(21) Appl. No.: 11/506,325

(22) Filed: Aug. 18, 2006

(65) Prior Publication Data

US 2007/0039756 A1 Feb. 22, 2007

Related U.S. Application Data

(60) Provisional application No. 60/709,347, filed on Aug. 18, 2005.

(51) Int. Cl.
*E21B 47/00* (2006.01)
*E21B 17/00* (2006.01)

(52) U.S. Cl. ..... 175/40; 166/242.5

(58) Field of Classification Search ..... 166/250.09, 166/242.5, 250.11; 175/40
See application file for complete search history.

(56) References Cited

U.S. PATENT DOCUMENTS 4,461,997 A * 7/1984 Ohmer ..... 324/338
5,934,391 A * 8/1999 Cox ..... 175/73
6,390,087 B1 * 5/2002 Wentworth et al. ..... 125/19
6,454,025 B1 * 9/2002 Runquist et al. ..... 175/61
6,523,609 B1 * 2/2003 Miszewski ..... 166/66
6,581,680 B1 * 6/2003 Wentworth ..... 166/65.1
6,588,515 B2 * 7/2003 Wentworth et al. ..... 175/19
6,658,575 B1 * 12/2003 Mizobuchi ..... 713/300
7,036,609 B2 * 5/2006 Michael et al. ..... 175/19
7,121,363 B2 * 10/2006 Michael et al. ..... 175/45
7,172,035 B2 * 2/2007 Michael et al. ..... 175/19
7,207,397 B2 * 4/2007 Miyamoto et al. ..... 175/50
2001/0017222 A1 * 8/2001 Wentworth et al. ..... 175/19
2002/0043406 A1 * 4/2002 Wentworth et al. ..... 175/61
2002/0043408 A1 * 4/2002 Wentworth et al. ..... 175/398
2002/0060095 A1 * 5/2002 Wentworth et al. ..... 175/73
2003/0131992 A1 * 7/2003 Michael et al. ..... 166/255.2
2003/0152428 A1 * 8/2003 Wentworth et al. ..... 405/184.2
2003/0183384 A1 * 10/2003 Das et al. ..... 166/250.11
2005/0205299 A1 * 9/2005 Michael et al. ..... 175/45

(Continued)

OTHER PUBLICATIONS

Product information for an end load sonde housing; website pp. 1 and 2; www.geologicalboring.com; Aug. 1, 2005.

(Continued)

*Primary Examiner*—Giovanna C Wright
*Assistant Examiner*—Cathleen R Hutchins
(74) *Attorney, Agent, or Firm*—Whitaker, Chalk, Swindle & Sawyer, LLP; Stephen S. Mosher

(57) ABSTRACT

An instrument housing for a drill string, comprising: a cylindrical housing having a cavity for receiving an instrument assembly such as a transmitter sonde; an elongated side load opening disposed parallel with and toward one end of the cavity and formed through a side of the cylindrical housing into the cavity. The side load opening is substantially shorter than the length of the instrument assembly; and an elongated side load door assembly is configured to fit within the side load opening, to enclose and secure the instrument assembly within the cylindrical housing such that the instrument is protected from loss or damage due to loss or damage to the side load door during operation.

14 Claims, 3 Drawing Sheets

U.S. PATENT DOCUMENTS

2006/0151213 A1* 7/2006 Michael et al. ..... 175/40

OTHER PUBLICATIONS

Transmitter Installation and Indexing Instructions; website pp. 1 and 2; www.geologicalboring.com; Aug. 1, 2005.

Product photograph of a "Standard Side Load Drill Head," part No. 226638001, manufactured by Vermeer Manufacturing, 1210 Vermeer Road, East, Pella, IA 50219. Photograph taken at a trade show in Houston, Texas in 2003.

* cited by examiner

SONDE HOUSING

The present application claims priority in U.S. Provisional Patent Application Ser. No. 60/709,347 filed Aug. 18, 2005 and entitled "Sonde Housing."

BACKGROUND OF THE INVENTION

1. Field of the Invention

The present application relates to drilling apparatus for directional drilling in utility installations and, more particularly, to housings for drill string instrumentation such as sonde transmitters and the like.

2. Background Description of the Prior Art

Horizontal Directional Drilling (HDD) is a means of boring horizontally underground to provide utility installations and remediation of utility installations already in place. While most open areas are "open trenched" with various trenching equipment, the HDD boring rigs are used to "drill" a bore path under obstacles such as rivers, roads, railroads, other existing utilities etc.

An HDD drill rig consist basically of a boring machine and a drill string including drill pipe, locating electronics (aka transmitter, sonde or transmitter beacon, typically configured as an instrument assembly for being enclosed or packaged within a tubular housing), and a boring bit attached to the front of the drill string. A bore path is plotted and laid out for the contractors. The drilling crew then drills at an angle into the ground along the bore path until the desired depth is reached. The bore is then leveled out and advanced under the obstacle. During this time the locating electronics instrumentation is installed between the drill bit and the drill pipe for transmitting the drill bit's depth, pitch and clock location (e.g., at 12, 3, 6, or 9 o'clock) to the surface. Once the desired bore length is reached under and past the obstacle, the bit is steered toward the surface. The pilot tool is then removed and a reamer can be used to open the hole to a larger diameter while pulling the drill pipe back. If the pilot hole is the desired size, the tool is removed and the pipe, conduit or "product" is pulled back through the hole. During drilling, the drill pipe is fed into the bore 10 to 15 feet at a time. Attached to the front of the drill pipe just behind the drill bit (or, alternatively, a mud motor) is the instrumentation package such as a sonde housing which houses and protects the sonde (transmitter).

With respect to the instrumentation package, currently there are two types of prior art sonde housing designs on the market. The first type of prior art housing is known as an "end load" sonde housing. The sonde is loaded from one end of the housing and secured therewithin. With no "door" or "lid" access to the sonde this design requires "breaking" the connection between housing and drill stem to obtain access to the sonde within the housing. However, this design allows for a full set of "water ports" to be machined within the wall space surrounding the sonde cavity allowing a large volume of drilling fluids to be pumped through the drill pipe and tool. The volume and pressure capacity of this design allow drillers to drive hydro/mechanical drilling tools in the hole often called "mud motors"

The "end load" design is preferred for its flow capabilities and the security it offers for the electronics in the sonde. Secured inside the end load housing, the sonde is rarely lost during the coarse of boring. However, since the transmitter is powered by batteries, the process of disconnecting the drill string from the housing and removing the sonde can be cumbersome and difficult. This is especially true on shorter, smaller diameter "in & out" bores where the tool usually remains on the drill pipe from bore to bore.

The second type of prior art housing is known as a "side load" housing. It is more popular for use with smaller machines without the large pump capacity for mud motor drilling. These rigs use a variety of bits that drill by rotational force from the drill rig transferred through the drill pipe. The side load design allows easy access to the sonde for maintenance, battery changes and replacement of the sonde. On a side load housing the sonde is installed through an opening in the side of the housing that is long enough for the sonde to be inserted laterally, with its axis parallel to the axis of the sonde housing. The sonde is inserted parallel with the housing and secured in place. A housing door or "lid" is then attached to the housing to cover and protect the transmitter.

The side load feature is a time saving design but reduces the number of water ports that may be provided to direct fluid from one end of the housing to the other. This fluid restriction is the primary reason this housing design is not used with the larger machines.

Another drawback to the side load design is that, on occasion during the drilling process, due to deterioration or extreme rotational torque, the side lids or doors become dislodged from the housing. Once the door is dislodged from a closed position or removed the sonde is completely exposed and typically protrudes from the housing or even falls out of the housing. At that point the sonde is usually irretrievable or damaged beyond repair. The cost associated with this failure is usually the loss of the sonde ($2,000-$5,000) plus the added expense of "tripping" out of the hole, making repairs" and tripping back into the bore.

What is needed is an instrument housing for a drill string that provides full protection for the instrumentation, allows full capacity water ports for use with mud motors, provides for ease of assembly into a drill string, and provides an easily adjusted clocking mechanism for the instrument package, and is low in cost of manufacture.

SUMMARY OF THE INVENTION

Accordingly, an instrument housing for a drill string is described herein, comprising: a cylindrical housing having a centered axial bore forming a cavity for receiving an instrument assembly such as a transmitter sonde, the dimensions of the cross section of the cavity exceeding the diameter of the instrument assembly by a predetermined clearance; an elongated side load opening disposed parallel with the longitudinal axis of the cavity, formed through a side of the cylindrical housing and into the cavity opening, the side load opening having a length substantially less than the length of the instrument assembly; and an elongated side load door assembly, having first and second ends and configured to fit within the side load opening, for enclosing and securing the instrument assembly within the cylindrical housing.

DETAILED DESCRIPTION OF THE INVENTION

Disclosed herein and illustrated in FIGS. 1 to 4 is one embodiment of a new side load housing for and instrument assembly called a transmitter sonde, sometimes referred to as a 'beacon.' While the specific embodiment describe herein is a sonde housing according to the present invention, the principles of the invention are applicable generally to cylindrical instrument housings having round or rectangular cross sections, that enclose a generally tubular instrumentation assembly, and that are typically used in harsh environments.

The sonde housing of the present invention illustrated in the appended figures provides a side-loaded sonde housing that is more resistant to damage to the side loading door assembly, and to the transmitter sonde (or, simply, sonde) itself, that may result from the torque applied to the drill string during drilling. The novel sonde housing design not only reduces the possibility of door loss but also protects and secures the sonde in the event the door does fail. As will be described, the clocking mechanism for use with the sonde is simplified, to reduce the time required to load and calibrate the sonde within the housing. This design also allows for an increased number (3 or 4 or 5) of water ports to accommodate the water flow capacity requirements of mud motors, as compared with prior art side load designs. In the description that follows, the reference numbers identifying the various structural features remain the same throughout the five figures when they refer to the same structures.

Figure 1:
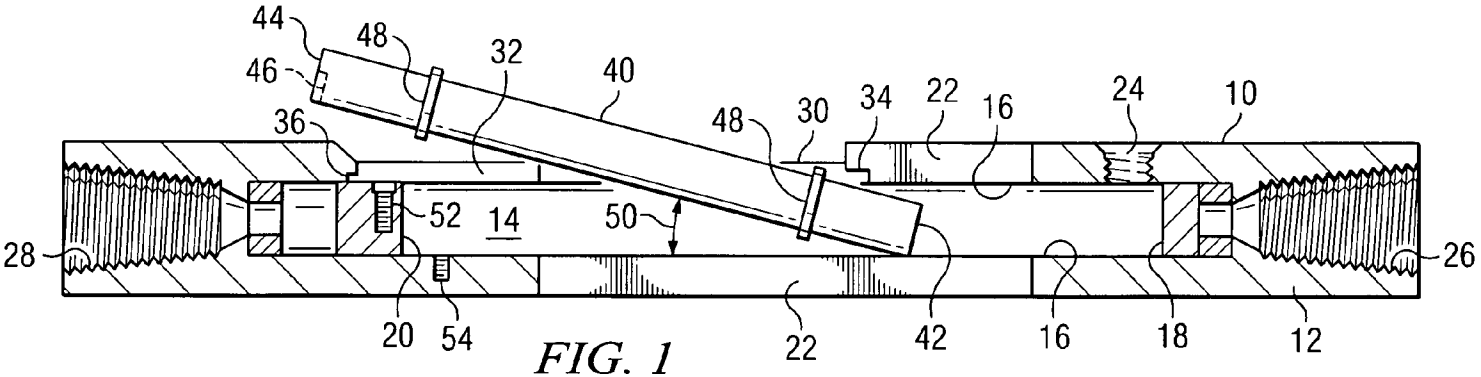
FIG. 1 illustrates a side view of one embodiment of a sonde housing according to the present invention, having a sonde partially installed therewithin.

Referring to FIG. 1, the side load sonde housing 10 of the present invention is made from either a tubular product or a solid material with a center bore or cavity 14 disposed along the longitudinal axis of the housing. The center cavity 14 may have a round cross section, or the cross section may be rectangular having interior wall surfaces 16 as in the illustrate embodiment shown in FIGS. 4 and 5. In other embodiments the cross section may have other shapes. The housing is typically fabricated from a heat treated and hardened 4140 or 4340 alloy of stainless steel. Around the center cavity 14 of the housing 10 in the body 12 (see FIG. 4 or 5) of the housing 10, several water ports 110 may be drilled the length of the housing 10. The size and number of these ports 110 is determined by the drill rig and pipe size and the type of tools being used. Typically there are at least 3 or 4 such water ports 110, although in conventional side load sonde housings having a full length side load door, the number of such side ports is limited to one or two such ports.

The center cavity 16 may be "plugged" and welded to provide a seal on each end 18, 20. A side load door opening 30 is machined through the body 12 of the housing 10. The door opening 30, which is shorter than conventional side load sonde housings, and disposed near one end of the cavity, is approximately 60% to 80% of the length of the sonde 40. Also machined in the body 12 of the sonde housing 10 are a series of narrow antenna ports 22 that permit the transmitted signal from the sonde or beacon 40 to be radiated from the sonde 40. There are typically five such ports (two are shown in FIG. 1), including one cut through the door 80, shown in a longitudinal cross section. In some embodiments, the antenna ports 22 are cut using a circular saw blade and produce an antenna port cross section as shown by the arcuate lines 96 in FIG. 2. Further, FIG. 1 illustrates a drilled, tapped, and countersunk hole called a "flush port" 24 for receiving a ¾ inch flush plug. The flush plug may be removed for cleaning the sonde housing 10 after use to remove mud, debris and other materials that accumulate in the housing 10 during drilling operations. At each end of the sonde housing 10, the housing is machined to be coupled with other drill string components at the tapered and threaded tool joints 26, 28.

Continuing with FIG. 1, the interior notches 34, 36 are machined in each narrow end of the opening 30 to allow the tabs 86, 88 machined on the door 80 to engage the housing 10. An interior ledge 32 is also machined around the perimeter of the opening 30 to support the door 80 and to eliminate any deflection of the door 80 into the cavity 14 by forces occurring in the drill string path. The body 12 of the housing 10 further includes a drilled and tapped hole 54 for a third bolt 94 to secure the door 80 to the body of the housing 10. A drilled and tapped hole 54 is also formed in the floor of the cavity in the housing to receive a second bolt 70 for securing the spacer 66 to the housing. The third bolt 94 and the second bolt 70, as well as a first bolt 64 to be described may each preferably be, for example, a nylon pelleted, socket head shoulder bolt.

To install the sonde 40 into the housing 10, the first end 42 of the sonde 40 is configured to be inserted into the center cavity 14 at an angle 50 relative to the longitudinal axis of the housing 10. Before insertion, the sonde 40 may be oriented rotationally, so that, in the position illustrated in FIGS. 1, 2, and 3, the keyway or slot 46 is positioned at an initial position of "6 O'clock" and pushed into the enclosed portion of the housing 10. Once fully inserted into the enclosed portion of the housing 10, whereby the inside end 42 is positioned against the end 18 of the cavity 14, and the indexing or exposed end 44 of the sonde 40 can be lowered into the cavity 14 and settled into position substantially inside the enclosed area of the housing 10. Resilient collars 48, such as O rings, are installed on the sonde 40 to center the sonde 40 within the cavity 14 and provide cushioning against mechanical shock. In the embodiment shown, for a typical sonde housing, approximately four inches of open space 100 (See FIG. 2) should remain in the open area of the cavity 14 after the sonde 40 is installed in the cavity 14.

Figure 2:
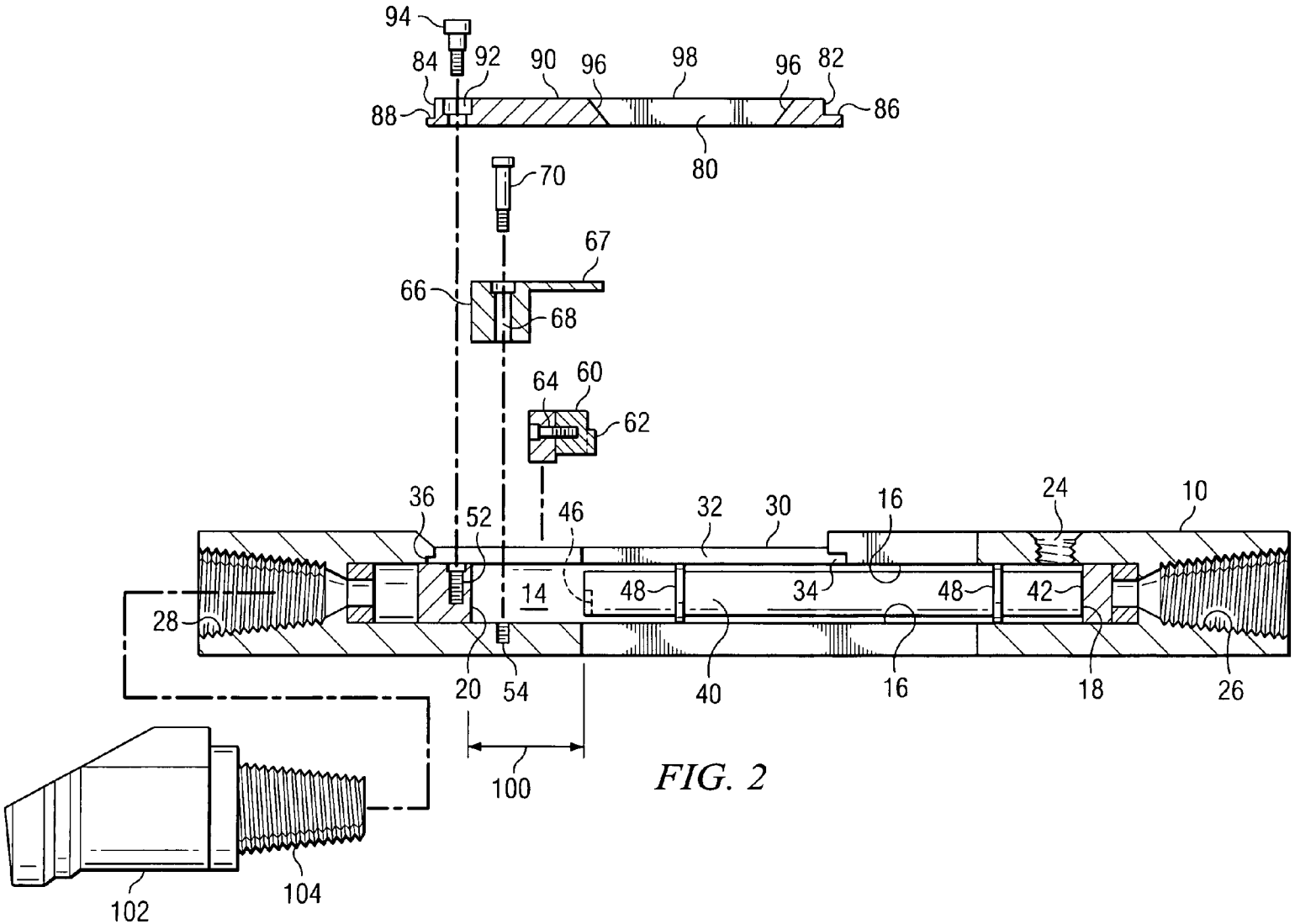
FIG. 2 illustrates an exploded side view of the embodiment of FIG. 1 including a clocking mechanism, a spacer assembly, and a side load door in position for assembly, and further having the sonde in place within the cavity of the sonde housing.

Referring to FIG. 2, since the sonde 40 is to be "clocked" or indexed in respect to the drill bit's installed position, the sonde 40 may be rotated inside the cavity 14 to the desired position for indexing. In FIG. 2, a two-piece "clocking mechanism" 60 is installed into the housing 10 and attached to the sonde 40 via the keyway or slot 46 formed in the end of the sonde 40. This clocking mechanism 60 secures the sonde 40 in the proper rotational relationship (calibration) and partially secures the sonde 40 in the housing 10. The clocking mechanism 60 itself may then be secured with a first bolt 64. First bolt 64 may be a socket head shoulder bolt.

Continuing with FIG. 2, once the clocking mechanism 60 is installed and secured with the first bolt 64, the spacer 66 is inserted to fill the remaining open space 100 in the cavity 14. The spacer 66 is designed with an extension or lip 67 that extends over the clocking mechanism 60 and a portion of the sonde 40 itself. The spacer 66 is secured to the bottom of the cavity 14 in the tapped hole 54 using the second bolt 70 and provides added measure of security for the sonde 40 should the door 80 (to be described) be lost. With the sonde 40, clocking mechanism 60 and spacer 66 installed, somewhat less than about half the length of the sonde 40 is exposed if the door 80 is lost as compared to the exposure of the entire 18" length of the sonde 40 when the prior art full length side load doors are lost.

The exploded view of the sonde housing 10 shown in FIG. 2 includes a door 80 for enclosing and securing the sonde 40 within the cavity 14 of the housing 10. The door 80 includes an exterior surface 90, a machined hole 92 for passage of the third bolt 94 therethrough, and an edge 98 on either side of the door 80 that fits along the interior ledges 32 of the sonde housing 10 when the door 80 is in place. After securing the spacer 66, the first end 82 of the door 80 with machined tab 86 is slid at an angle completely into the first notch 34 in the housing 10 and then slid in the opposite direction along the supporting interior ledges 32 (See FIG. 1) within the bore 16 to engage the second tab 88 into the second notch 36. The door 80 is then secured to the housing 10 using the third bolt 94. The housing 10 may include tool joints 26, 28 on either end, as previously described.

Continuing with FIG. 2, a drill bit 102 having a threaded male end 104 is shown in an aligned position in preparation to be threaded into the female socket end of the tool joint 28 of the sonde housing 10.

Figure 3:
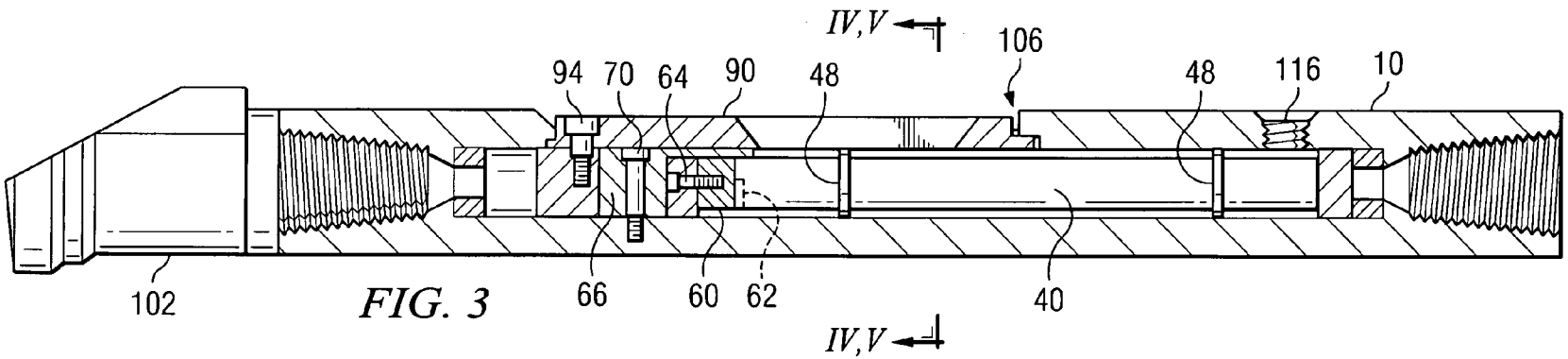
FIG. 3 illustrates a side view of the embodiment of FIGS. 1 and 2 following assembly.

Referring to FIG. 3, an instrument housing 10 for a transmitter sonde 40 according to the present invention is shown with the sonde 40 installed and indexed or "clocked" within the housing 10 in a proper orientation to correspond to the position of the drill bit (not shown) as described herein above. It will also be observed that once the door 80 is placed in its final position, a slight gap 106 remains between the end 82 of the door 80 and the end of the opening 30 that receives the door 80. However, only part of the tab 86 is exposed, the rest (and most) of its length remaining within the housing 10. Also shown in FIG. 3 is the ¾ inch (typically) "flush plug" 116 in place in the hole 24 provided. FIG. 3 further illustrates the drill bit 102 installed in position tool joint 28.

Figure 4:
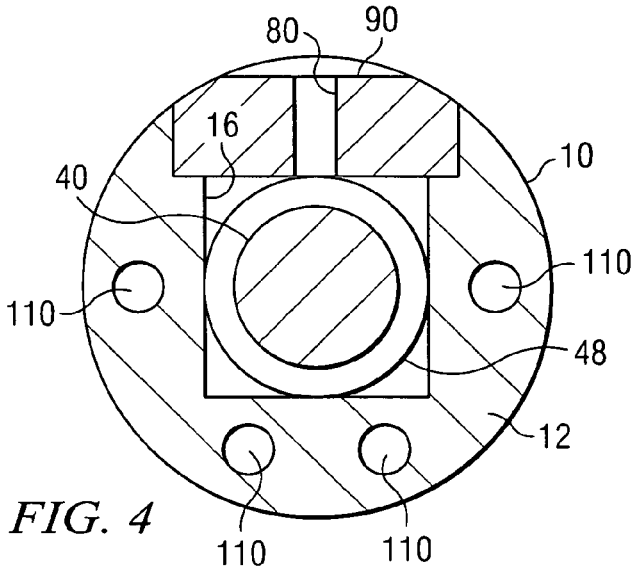
FIG. 4 illustrates a cross section view of one embodiment of the sonde housing of FIG. 3.
Figure 5:
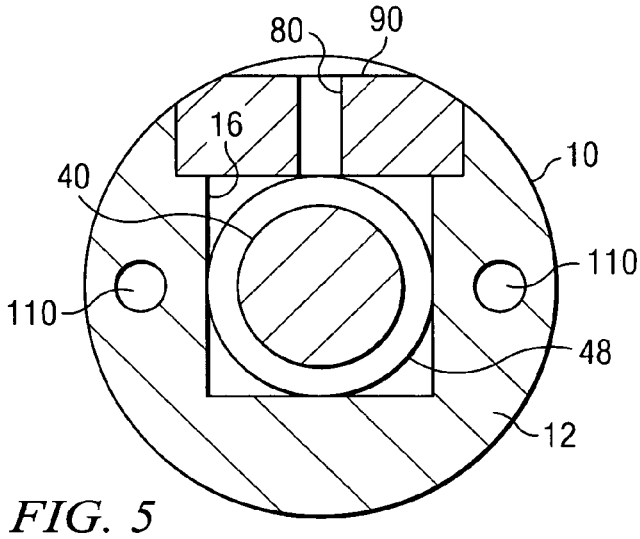
FIG. 5 illustrates a cross section view of an alternate embodiment of the sonde housing of FIG. 3.

Referring to FIGS. 4 and 5 there are illustrated cross sections of the sonde housing 10 with the transmitter sonde 40 installed, taken at the position indicated by the Roman Numerals IV and V respectively in FIG. 3. FIGS. 4 and 5 depict respective embodiments of a sonde housing 10 having four water ports 110 disposed in the body 12 of the sonde housing 10 (FIG. 4) and two water ports 110 disposed in the body 12 of the sonde housing 10 (FIG. 5). The embodiment of FIG. 4 is especially suited for sonde housings used with mud motors, which require relatively large volumes of water be pumped through the body of the sonde housing. The embodiment of FIG. 5 is suited for drilling operations where a mud motor is not used.

While the invention has been shown in only one of its forms, it is not thus limited but is susceptible to various changes and modifications without departing from the spirit thereof. For example, one version of the sonde housing 10 is available wherein the cross section may be any of three diameters adapted to 3.0", 3.5", and 4.5" drill bits. The invention including its various component parts is readily scaled.

What is claimed is:

1. An instrument housing for a drill string, comprising:

a cylindrical housing having an elongated cavity having a closed end and an open end and disposed within the housing along a predetermined portion of a longitudinal axis of the housing, for receiving an instrument assembly of an axial length therewithin;

an elongated side load opening disposed substantially along the longitudinal axis, formed through a side of the cylindrical housing and into the cavity and having an axial length substantially less than the axial length of the instrument assembly, wherein the side load opening is disposed toward the open end of the cavity; and an elongated side load door assembly having first and second. ends and configured to fit the side load opening, for enclosing and securing the instrument assembly within the cavity of the cylindrical housing.

2. The apparatus of claim 1, further comprising:

a spacer device adapted to support the instrument assembly within the cavity of the cylindrical housing after installation of the instrument assembly therewithin.

3. The apparatus of claim 2, wherein the spacer device comprises a spacer and an indexing assembly.

4. The apparatus of claim 2, further comprising: an indexing assembly disposed within the cavity adjacent an indexing end of the instrument assembly for indexing the instrument assembly to the position of a drill bit in the drill string.

5. The apparatus of claim 1, further comprising at least a first internal notch formed into an interior surface of the cavity at a first end of the elongated side load opening for receiving a corresponding tab extension formed into the first end of the elongated side load door assembly for securing the first end of the elongated side load door assembly to the cylindrical housing.

6. The apparatus of claim 5, further comprising means for securing the second, opposite end of the elongated side load door assembly to the cylindrical housing.

7. The apparatus of claim 1, further comprising: an instrument assembly disposed within the cavity of the cylindrical housing and having a first end and an indexing end thereof and containing instrumentation for sensing and transmitting data.

8. The apparatus of claim 7, further comprising:

at least first and second resilient outer ring collars installed at respective first and second positions along an outer surface of the instrument assembly, for supporting the instrument assembly in axial alignment within the cavity of the cylindrical housing.

9. The apparatus of claim 7, wherein the first end of the instrument assembly is inserted through the side load opening into the cylindrical housing and toward the closed end of the cavity in the cylindrical housing.

10. The apparatus of claim 1, wherein the instrument assembly comprises instrumentation for sensing and transmitting data regarding at least one or more of depth, pitch and clock position of a drill bit of a drill string during use in a horizontal drilling operation.

11. The apparatus of claim 10, wherein the instrument assembly is a transmitter sonde.

12. The apparatus of claim 1, wherein the cylindrical housing is fabricated as a single piece of material.

13. The apparatus of claim 1, wherein the dimension of the cross section of the cavity exceeds the corresponding dimension of the cross section of the instrument assembly by a predetermined clearance.

14. The apparatus of claim 1, wherein the side load opening is disposed toward the open end of the cavity, and wherein further the corresponding end of the side load opening overlaps the open end of the cavity by a predetermined amount.

* * * * *